United States Patent [19]

Baier

[11] 4,149,488

[45] Apr. 17, 1979

[54] DEFLECTING GUIDE FOR DEVELOPER MIXTURE

[75] Inventor: Erich Baier, Suenzhausen, Fed. Rep. of Germany

[73] Assignee: Siemens Aktiengesellschaft, Berlin & Munich, Fed. Rep. of Germany

[21] Appl. No.: 853,282

[22] Filed: Nov. 21, 1977

[30] Foreign Application Priority Data

Feb. 17, 1977 [DE] Fed. Rep. of Germany ..... 2706816

[51] Int. Cl.[2] ..... G03G 13/09

[52] U.S. Cl. ..... 118/658

[58] Field of Search ..... 118/657, 658, 653, 656

[56] References Cited

U.S. PATENT DOCUMENTS

| | | | |
|---|---|---|---|
| T959,003 | 6/1977 | Hull | 118/658 |
| 3,099,856 | 8/1963 | Eichorn et al. | 15/256.52 |
| 3,180,239 | 4/1965 | Shearer et al. | 118/658 X |
| 3,455,276 | 7/1969 | Anderson | 118/658 |
| 3,641,969 | 2/1972 | Hakanson | 118/658 X |
| 3,881,446 | 5/1975 | Kurita et al. | 118/657 |
| 3,921,577 | 11/1975 | Howard et al. | 118/658 |
| 3,968,773 | 7/1976 | Charland et al. | 118/658 |
| 3,985,099 | 10/1976 | Nagashima et al. | 118/658 |
| 4,048,957 | 9/1977 | Tagawa | 118/653 |
| 4,075,977 | 2/1978 | Williams | 118/658 |

*Primary Examiner*—Mervin Stein

*Attorney, Agent, or Firm*—Hill, Gross, Simpson, Van Santen, Steadman, Chiara & Simpson

[57] ABSTRACT

A toner feeding assembly for feeding a developer mixture of a toner and carrier particles to an intermediate carrier which has been electrostatically charged, the feeder mechanism employing magnetic brushes of the rotating cylinder type, at least one of the brushes being adjacent the intermediate carrier. An excess toner deflecting guide member is positioned adjacent the magnetic brush-intermediate carrier nip having one long side edge projecting towards the nip and an opposite long side edge positioned away from the nip and below the one edge. The guide is effective to direct a film of developer mixture away from the nip area and back to a developer mixture reservoir.

5 Claims, 1 Drawing Figure

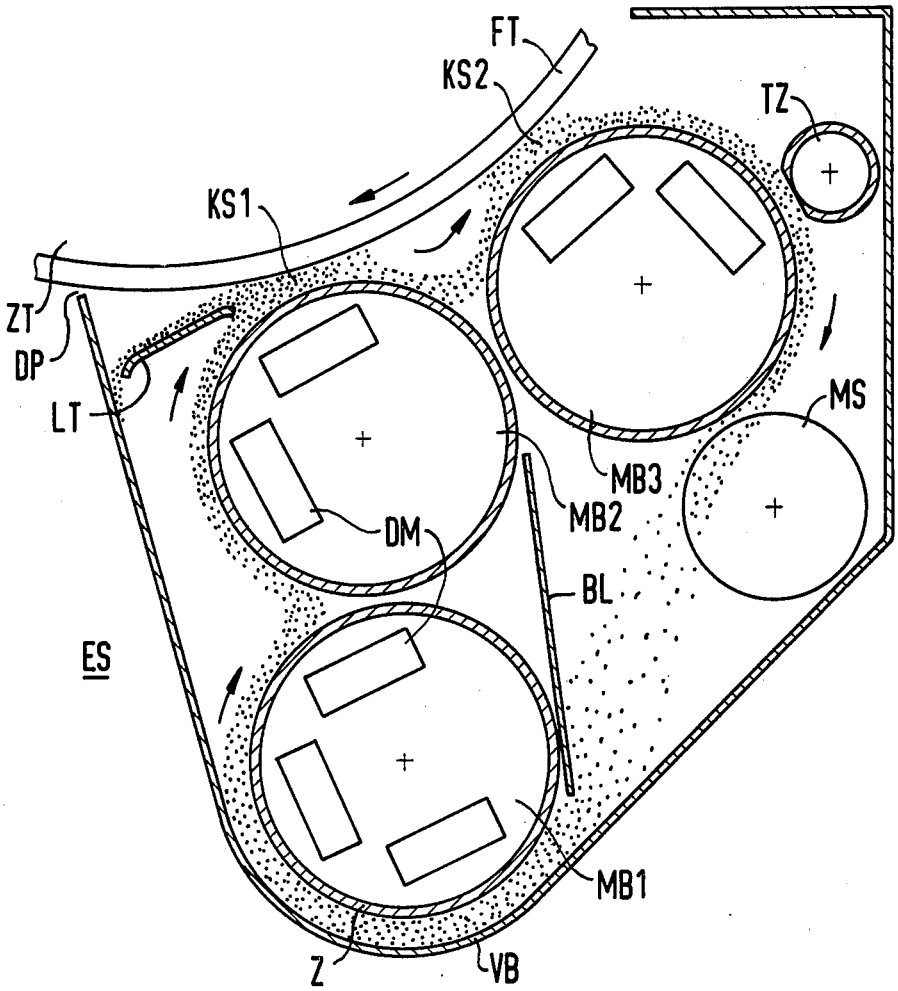
FT
KS2
TZ
KS1
ZT
DP
LT
MS
MB3
MB2
DM
BL
ES
MB1
Z
VB

DEFLECTING GUIDE FOR DEVELOPER MIXTURE

BACKGROUND OF THE INVENTION

1. Field Of the Invention

The present invention relates to electrostatic copiers and particularly that class of copier which utilizes a developer mixture composed of a toner and carrier particles where the mixture is transported from a reservoir to an intermediate carrier by means of magnetic brushes.

2. Prior Art

In general this invention relates to devices for developing electrically charged images which images have been imposed on an intermediate carrier member by an electrostatic technique. Such devices are herein called copiers. Development of the images is through the use of a developer mixture made up of a toner and carrier particles. The developer mixture is transported from a developer mixture reservoir onto selected areas of the intermediate carrier in the outline of the desired image by means of rotating cylinders of the type known as magnetic brushes. Such devices are primarily found in copying machines and non-mechanical printers.

The generation of characters or images on a data carrier, for example, a paper sheet or web, by means of electrostatic copying is well known. See for example U.S. Pat. No. 3,099,856. In such devices electric charge latent images of the character to be reproduced are produced either electrographically or electrophotographically on an intermediate carrier, for example a drum which has a dielectric or photoelectric layer. These charge images are then developed using a toner to provide a toner image on the drum. The toner image is subsequently transferred at a transfer station to the paper or other data carrier. Thereafter the transferred toner images can be fused to the data carrier at a fixing station.

In copiers of this class, it is well known to utilize devices known as magnetic brushes for the development of the charge images on the intermediate carrier by the transfer of the toner to the image area. See for example U.S. Pat. No. 3,455,276. The magnetic brushes of the above mentioned type may consist of rotatable cylinders which have permanent magnets positioned interior thereof. The developer mixture which is used to develop the charge image on the intermediate carrier is a compound or admixture of toner and magnetic material carrier particles. The developer mixture is removed from a developer-mixture reservoir by means of a magnetic brush which passes through the reservoir and which thereafter transports the developer mixture to the intermediate carrier. In providing a path from the reservoir to the intermediate carrier for the developer mixture, one or more magnetic brushes may be arranged side by side with their internally positioned magnets being poled in such a manner that the developer mixture will be passed from one magnetic brush to the next adjacent magnetic brush.

By use of such magnetic brushes, the developer mixture will be conveyed past the intermediate character in such a fashion that the toner in the developer mixture can transfer to the intermediate carrier precisely at the location on the intermediate carrier where the charge images have been formed. The carrier particles and the toner not adhering to the intermediate carrier thereafter drop back to the reservoir.

In high performance units, for example nonmechanical high speed printers, the supply of the developer mixture to the intermediate carrier involves the transfer of a relatively high quantity of developer mixture. Only by transfer of a large quantity from the reservoir is it possible to properly develop the latent images on the intermediate carrier. This supply of large quantities of developer mixture can be achieved by use of several magnetic brushes, high transport speeds, strong magnets interior of the brushes and the like. It is important in such devices, however, that the developer quantity at the point of transfer between the intermediate carrier and the magnetic brush should be precisely metered. On one hand, the developer mixture should not be so thin in the transfer zone or development zone so as to prevent achievement of an adequate development of the charge image which would occur if insufficient toner is present at the nip area between the transfer magnetic brush and the intermediate carrier. On the other hand the mixture should not be present at the nip area in such a large degree as to be squashed between the brush and intermediate carrier since this will both cause wear of the surface of the intermediate carrier and prevent achievement of a clean background on the final print. Thus metering of the quantity of developer material at the nip area of toner transfer is important.

SUMMARY OF THE INVENTION

It is therefore a principle object of this invention to provide a device for developing latent, charge images formed on an intermediate carrier using magnetic brush transferred developer mixture while providing means to assure that the supply of mixture to the developing zone of the device can be properly limited.

The principle object of this invention is achieved by providing a guide device in the area between the intermediate carrier and the magnetic brush which supplies the developer mixture to the intermediate carrier. The guide device extends over the full axial length of the intermediate carrier and assures that an excess portion of the developer mixture supplied by the brush to the intermediate carrier will be deflected back away from the carrier to the reservoir.

The guide device, in the preferred embodiment illustrated, may consist of a simple elongated plate bent at both long side edges. The plate has one long side edge projecting towards the nip area between the magnetic brush and the intermediate carrier with the other long side edge of the plate being located below the first edge and pointing away from the brush.

By using the guide device of this invention, part of the developer mixture, conveyed by the brush to the intermediate carrier, will be returned from the transfer zone or contact area in the form of a film or carpet of the developer mixture. This film or carpet is then directed back to the reservoir. The film or carpet of developer mixture is formed because of the magnetic force lines which exist in the transfer zone and further because of the tendency of the carrier particles to be attracted and adhere to one another. The quantity of developer mixture which will be conveyed away from the transfer zone will be dependent upon the quantity of developer mixture transported by the magnetic brushes to the transfer zone. In this manner variations in the quantity of developer material being transported to the transfer or development zone can be automatically compensated for. Since the guide plate is provided at the in-feed side of the transfer zone nip area, excess quantities of developer material will be withdrawn from the nip area before they pass through the area thus eliminating the squashing of excess material between the magnetic brush and intermediate carrier.

Additional advantages arise from use of the guide device. These advantages include reduction or elimination of adhesion of carrier particles to the surface of the intermediate carrier. If the guide device is not present, the possibility exists that carrier particles flung away from the magnetic brushes due to the brush rotation would adhere to the intermediate carrier and escape from the developer station. The existence of carrier particles adhering to the intermediate carrier adversely effects the quality of the final image formed upon transfer of the toner image from the intermediate carrier to the data carrier. It has been found that provision of the guide device at the described area prevents adhesion of carrier particles to the intermediate carrier. An additional advantage of the guide device according to this invention lies in the fact that the carpet or film of developer mixture which is drawn off by means of the guide device pevents escape of toner to the atmosphere from the development or transfer station. The guide device, in association with the carpet or film of developer mixture, functions as a seal with respect to the toner at the area where the intermediate carrier leaves the developer station.

It is therefore an object of this invention to provide, in association with an electrostatic copier having a developer station in which an admixture of toner and carrier particles is moved from a reservoir to a latent image developing transfer section by magnetic brushes, a guide device having a long broad side edge directed at, and in close proximity to, the nip area between a toner supply brush and an intermediate carrier at a latent image transfer station, the guide device having a second long broad side edge spaced from the nip area away from the transfer magnetic brush and having a position below the first broad side edge, the guide device effective to deflect a film or carpet of the developer mixture back away from the nip area and into the reservoir.

It is another, particular, object of this invention to provide a means for controlling supply of a developer mixture comprised of toner and carrier particles to a transfer station nip area between a magnetic brush and an intermediate carrier by providing a guide device adjacent the nip area which directs a film of excess developer mixture back away from the nip area prior to movement of the mixture through the nip area.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWING

The FIGURE illustrates, in cross section, a somewhat diagrammatic view of a developer station according to this invention.

As shown in the FIGURE, developer station ES is equipped with three magnetic brushes of known structure and arrangement. The brushes, MB1, MB2 and MB3 provide for movement of developer mixture from a reservoir to the intermediate carrier. Of course, it is to be understood that a greater or lesser number of magnetic brushes MB may be used if desired. The magnetic brush MB1 is positioned adjacent the bottom of the reservoir VB which holds a supply of developer mixture consisting of toner and carrier particles. An intermediate carrier ZT projects into an opening in the developer station ES. The intermediate carrier ZT, which moves with respect to the developer station, may, for example, be a drum with a photoelectric surface FT. Furthermore the developer station ES includes a toner supply device TZ and a mixing spindle MS.

The magnetic brushes MB may be of known designs and consist of cylinders Z with permanent magnets DM positioned interiorly thereof. Because the particular structure of the magnet brushes MB is well known, see for example U.S. Pat. No. 3,455,276, the teachings of which are herein incorporated by reference, no further description of the magnetic brushes is necessary. Furthermore, further description or discussion of the toner supply device TZ or the mixing spindle MS is not felt to be necessary since they form no part of the substance of the invention and additionally are well known within the art.

Developer mixture is indicated in the FIGURE by dots and the direction of rotation of the cylinders Z of the magnetic brushes MB1, MB2, and MB3 is indicated by adjacent arrows. Further the direction of rotation of the intermediate carrier FT is indicated by an arrow and is to be seen to be opposite the rotation of the magnetic brushes MB.

The first magnetic brush MB1, is positioned adjacent a bottom of the reservoir. The developer mixture, attracted to the magnetic brush by the interior magnets, will be transported from the reservoir bottom to the second magnetic brush MB2. The magnetic brush MB2 will pick up a film or carpet of developer mixture from the brush MB1 and will carry it, by rotation of its cylinder to an area of close proximity to the surface FT of the intermediate carrier ZT. The developer mixture conveyed by magnetic brush MB2 will then be carried past the intermediate carriers ZT through a nip area and, at this point, toner will be able to cross to the surface FT of the intermediate carrier. The area in which the developer mixture is conveyed passed the intermediate carrier ZT is referred to as the contact location or nip area KS1.

Adjacent the second magnetic brush MB2 there is a third such brush MB3 which picks up a carpet of undeposited developer mixture from the brush MB2 and also conveys it past the surface FT of the intermediate carrier ZT through a second contact location or nip KS2 in which toner can again cross to the intermediate carrier ZT. The developer mixture not consumed in the developing of latent images on the intermediate carrier ZT will be conveyed back by the third magnetic brush MB3 to the reservoir VB. Adjacent the third magnetic brush MB3, the toner supply TZ makes up the toner consumed during the development of the latent image. Thereafter the development mixture returning to the reservoir VB from magnetic brush MB3 will be remixed with the aid of the mixture spindle MS. A baffle plate BL in the reservoir insures that the developer mixture dropping into the reservoir is returned to the area of the first magnetic brush MB1.

As pointed out above, in nonmechanical high speed priners and copiers it is necessary to increase the quantity of developer mixture being conveyed past the intermediate carrier ZT. At the same time, however, it is desirable that an excessive quantity of developer mixture not be introduced to the nip areas KS1, KS2. In order to achieve a correct metering of the quantity of developer mixture at the nip areas KS1, KS2, a guide device LT is provided within the developer station ES.

The guide device LT is an elongated plate extending the width of the intermediate carrier TZ and has two long broadside edges. The plate ZT may be slightly curved at the broadside edges as illustrated in the FIGURE. The plate is positioned within the developer station ES such that a first broadside edge is positioned adjacent the nip area KS1 with the first broadside edge directed towards the nip area and a second broadside edge being spaced away from the nip area in the direction of rotation of the intermediate carrier. The guide device LT is placed on the in-feed side of the nip KS1 having its second broadside edge positioned below its first broadside edge.

The guide device LT will deflect part of the film or carpet of developer mixture being conveyed by the magnetic brush MB2 before it reaches the nip area KS1. Further the guide plate will deflect a portion of the developer mixture in the form of a film or carpet of developer mixture which is then returned by the guide plate to the reservoir VB. The carpet or film of developer mixture being deflected by the guide plate LT is created because of the magnetic force lines present in the indicated area of the developer station ES and because of the tendency of the carrier particles within the developer mixture to adhere to one another.

The quantity of developer mixture returned by the guide device LT will depend upon how much developer mixture is being conveyed to the nip area KS1 by the magnetic brush MB2. By means of the guide device it is therefore possible to insure that, within limits, an excessive supply of developer mixture will not be delivered to the nip area KS1.

Additionally the guide device LT effectively insures that no carrier particles will adhere to the intermediate carriers ET or escape from the developer station ES. Because of the return path carpet of developer mixture formed with the aid of the guide device LT, carrier particles which might otherwise be whirled away from the magnetic brushes MB will be restrained and recaptured. Furthermore, at the location illustrated for the guide device, the magnetic attraction force will dominate the electrostatic attraction force of the intermediate carrier. Therefore, carrier particles adhering to the intermediate carrier will be withdrawn from the carrier ZT by the effect of the extra carpet or film of developer mixture formed with the aid of the guide device LT and will return to that extra film.

Additionally, the formation of this film of particles being returned back to the reservoir at this position effectively forms a seal sealing toner dust within the developer station ES which toner dust might otherwise escape at the slot DP between the developer station ES and the intermediate carriers ZT. This insures that large quantities of toner dust will not escape to the atmosphere at the sealing slot DP and contaminate the environment of the developer station ES.

It can therefore be seen from the above that this invention provides a device for metering the amount of developer mixture being presented by a magnetic brush to an intermediate carrier contact area or nip to insure that excess quantities of developer mixture will not be squashed through the nip and thereby adversely effect the quality of the final developed image. The device includes a guide device which consists of an elongated plate which preferably extends the length of the intermediate carrier within the toner application area and which has a leading broadside edge projecting towards the nip and in close proximity thereto and a trailing long side edge, in the direction of rotation of the intermediate carrier, spaced away from the nip and below the leading broadside edge. Because of the magnetic force lines which exist within this area, and due to the tendency of the carrier particles of the developer mixture to adhere to one another, a film of excess developer mixture will be directed away from the nip area and back towards the reservoir. Since the guide plate is positioned on the in-feed side of the nip area, this redirected film developer mixture will prevent, within limits, the supplying of too great a quantity of developer mixture to the nip.

Although the teachings of my invention have herein been discussed with reference to specific theories and embodiments, it is to be understood that these are by way of illustration only and that others may wish to utilize my invention in different designs or applications.

I claim as my invention:

1. An electrostatic copier comprising: an intermediate carrier to which a latent image can be applied, a developer station for applying a toner to the intermediate carrier in areas defined by the latent image, a reservoir containing a developer mixture of toner and carrier particles in said developer station, at least one magnetic brush means in said developer station effective to move developer mixture from the reservoir to a contact location where toner in the mixture will transfer from the brush means to the intermediate carrier and means metering the amount of mixture being presented at the contact location, said metering means being positioned closely adjacent a nip area formed between the brush means and the intermediate carrier and effective to redirect an excess portion of the mixture being presented by the brush means to the nip area back away from the nip area from a throat opening of the nip area and towards a sump area of the reservoir, said metering means being effective to cooperate with magnetic lines of force adjacent the nip area to draw off a first film of mixture from a second and larger film of mixture being moved by the brush means and to direct the first film of mixture back away from the nip area over a top surface of the metering means towards the reservoir, the top surface of the metering means lying on a side of the metering means remote from the reservoir, the first film moving away from the nip area.

2. The copier of claim 1 wherein the metering means comprises plate means within the developer station, said plate means having a length substantially as long as the intermediate carrier, said plate means having a leading broadside edge and a trailing broadside edge spaced from the leading broadside edge, the leading broadside edge being positioned closer to the nip area than the trailing broadside edge at an infeed side of the nip area, the leading broadside edge being at a throat opening to said nip area with the leading broadside edge directed towards said nip area and the trailing broadside edge directed away from said nip area spaced further from the brush means than the leading broadside edge and being positioned below the leading broadside edge.

3. The copier of claim 2 wherein the plate means is positioned adjacent an exit slot where the intermediate carrier exits the developer station, the plate means additionally being effective to aid in maintaining a seal at said slot preventing escape of toner dust from the developer station through said slot.

4. In a device for developing charge images produced on an intermediate carrier by an electrostatic technique wherein development is performed with the aid of a developer mixture of toner and carrier particles and wherein the developer mixture is transported from a reservoir by means of magnet brush means to the intermediate carrier and conveyed past the intermediate carrier, the improvement of: providing a guide device at a nip area formed between the intermediate carrier and the magnetic brush supplying the mixture to the intermediate carrier, the guide device extending parallel to the axis of the intermediate carrier and having a length substantially at least as great as the axial length of the intermediate carrier in opposition to the magnetic brush, the guide device having a leading edge terminating closely adjacent the nip and directed into a throat opening of the nip, the guide device effective to deflect a portion of the mixture being supplied to the intermediate carrier by the brush away from the intermediate carrier and back to the reservoir before said portion passes through the nip, the guide device cooperating with magnetic lines of force adjacent the nip area to draw off a portion of the mixture as a film of mixture, the portion being drawn off on a downstream side of the guide device in the direction of movement of the magnetic brush, the film moving back away from the nip area over a top surface of the guide device.

5. A device according to claim 4 wherein the guide device comprises a plate having leading and trailing broadside edges, said edges being bent downwardly with respect to an intermediate portion of said plate intermediate said edges, said leading edge projecting into the throat opening of a nip area between the magnetic brush and the intermediate carrier and terminating in spaced relation to both the magnetic brush and the intermediate carrier, the trailing broadside edge of the plate being positioned below the leading broadside edge and being spaced further away from the throat opening than said leading broadside edge.

* * * * *